United States Patent [19]

Banner

[11] 4,024,526

[45] May 17, 1977

[54] ALARM DEVICE FOR USE IN COMBINATION WITH WINDOW SASH

[76] Inventor: Joseph Banner, 400 Glenway Road, Erdenheim, Pa. 19118

[22] Filed: May 19, 1976

[21] Appl. No.: 687,718

[52] U.S. Cl. ..... 340/274 R; 200/61.93; 340/256

[51] Int. Cl.[2] ..... G08B 13/06

[58] Field of Search ..... 340/274 R, 256; 200/61.93, 51.1, 42 R

[56] References Cited

UNITED STATES PATENTS

| | | | |
|---|---|---|---|
| 3,427,608 | 2/1969 | Green | 200/61.93 |
| 3,530,262 | 9/1970 | Hawkins | 340/274 R |
| 3,634,845 | 1/1972 | Colman | 340/274 R |
| 3,911,414 | 10/1975 | Bowling | 340/274 R |

*Primary Examiner*—Glen R. Swann, III
*Attorney, Agent, or Firm*—Benasutti Associates, Ltd.

[57] ABSTRACT

An alarm device comprises essentially a circuit and an activation means, which in turn comprises a releasable plug and jack. When the plug is removed from the jack, the circuit is broken and the alarm is triggered. The jack is positioned in such a way with respect to various types of window sash that the windows can be partially opened to allow ventilation, but cannot be fully opened to allow access through the window without removing the plug.

10 Claims, 8 Drawing Figures

ALARM DEVICE FOR USE IN COMBINATION WITH WINDOW SASH

BACKGROUND OF THE INVENTION

This invention relates to alarm devices, and more particularly, to such devices for use in combination with window sashes or various types, as might be found in apartments, residences and the like.

In the prior art there have been many attempts to provide burglar alarm systems in connection with windows and doors of the type commonly found in residences. The circuitry involved ranged from the simple to the complex, as did the structure. Reference in this regard is made to the following U.S. Pat. Nos. Brune, 1,227,994; Winsett 1,959,253; Fleischmann 2,084,841; Abate 2,752,876; Stevens 3,499,132; Beck 3,567,882; Takahashi 3,710,369; Williams 3,742,479.

Burglar alarms of this type have made use of what is known as a jack and a plug, as for instance shown in U.S. Pat. No. 3,495,054 (Lea). Other devices have attempted to provide a means whereby the potential burglar cannot defeat the alarm system by jumping the alarm actuating means; such as shown in U.S. Pat. No. 2,912,540 (Sawicki). This is, indeed, of great importance and presents a problem in the prior art.

SUMMARY OF THE INVENTION

I have noted the prior art problems, and in addition, I have found that it is desirable to make a device which allows the window to be partially opened for purposes of ventilation, and yet still prevent access through the window by a burglar. I have further noted that it is desirable in such a system to provide a means for fully opening the window under certain circumstances without rendering the burglar alarm permanently disabled for any substantial period of time. Accordingly, I have developed an apparatus for accomplishing these desirable ends and for overcoming the problems of the prior art. This apparatus comprises a device which is so positioned with respect to the window sash that the window can be partially opened under normal conditions without activating the alarm, can be fully opened under other conditions without activating the alarm, and will cause the alarm to actuate under normal conditions if the window is fully opened. The basic elements of this invention comprise a circuit means connected to an alarm means which is activatable by an actuation means connected to the circuit means. The actuation means has a first portion which is normally engaged with the circuit and a second portion which is removably retained by the first portion. The second portion coacts with the first portion in the retained condition to complete the circuit and prevent the actuation of the alarm. In its separated condition the alarm will normally actuate. The actuation means is positioned with respect to the movable members of a window sash such that when the window is partially opened the actuation means will not interfere with the window and air may pass through the opening provided. However, if the window were to continue in its path of opening, the actuating means would interfere with its progress and would have to be removed from the portion which releasable retains it, and therefore the alarm would be actuated. I also provide a switch which can de-activate the alarm so that an alternative second portion can be inserted into and be removably retaned by the first portion, and thereby complete the circuit. Thereafter, the switch can be thrown in the opposite direction, which would normally activate the alarm, or at least allow it to be actuated. Since the alternative second portion is in place and is so constructed as not to interfere with the travel of the window, the window can thereafter be opened fully without actuating the alarm.

In a still further embodiment, I provide a means whereby the essentials of this invention can be used in combination with an extended bracket to prevent a plurality of windows from opening in more than one direction, and in a still further embodiment, I provide an alternate means for accomplishing this result when the windows are hung to open and close vertically.

It is accordingly an object of my invention to improve and simplify window sash burgular alarm systems, and this and other objects of my invention will become apparent from the following description with reference to the accompanying drawings.

DESCRIPTION OF THE PREFERRED EMBODIMENTS

Figure 1:
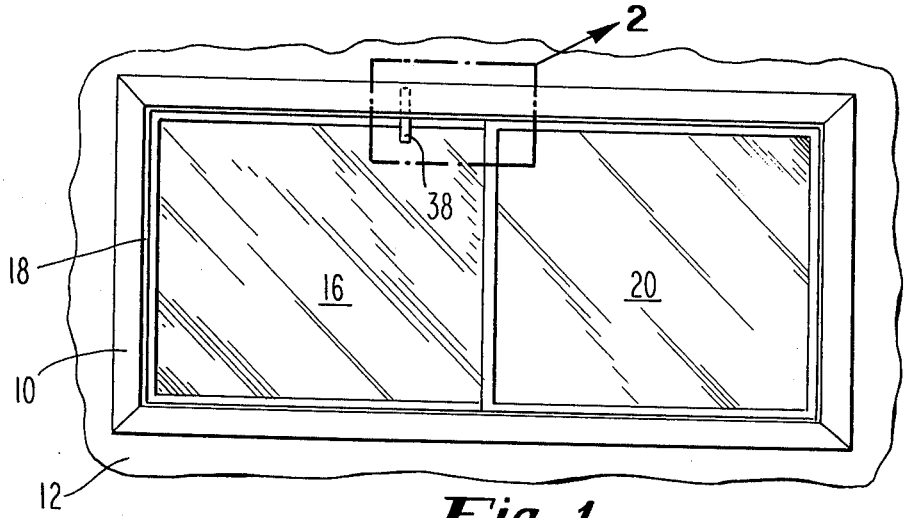
FIG. 1 is a front view of a window shown mounted in a wall wherein the window sash is hung so as to slide to and fro horizontally.

Although specific forms of the invention have been selected for illustration in the drawings and the following description is drawn in specific terms for the purpose of describing these forms of the invention, this description is not intended to limit the scope of the invention which is defined in the appended claims.

Referring to the figures, FIG. 1 shows a window frame 10 in a wall 12, wherein there is mounted window sash which is slidable to and fro horizontally in overlapping relation. Such sash is typical of the metal windows in apartments and modern housing and the like, and normally includes a channel in which the window sash slides. The channel is shown greatly enlarged in FIG. 2 at 14, and is generally U-shaped in cross section. Where, as here, there are two sash members, the channel will be W-shaped in cross section so that one sash, such as 16 in FIG. 2, slides on one side of central web member 18 and the other sash 20 slides on the other side of the web member.

I will now describe the basic and preferred embodiment of my invention, which prevents the opening of such a sash 20 past a predetermined point, and thereby prevents a burglar from entering through the open window, while at the same time allowing the sash to be opened to a predetermined point to allow for ventilation. In this preferred embodiment, there is an alarm 22 (shown schematically in FIG. 2), a circuit designated generally 24, which will not be described in detail but which will certainly be obvious and well known in view of the art, and an actuator means designated generally 26 engaging the circuit which in turn is connected to the alarm and which serves to activate the alarm under various conditions, which will be more fully described hereinafter.

The actuator means in this embodiment comprises a jack 28 which is mounted through the upper portion 30 of the channel 18 holding the sash, and into the surrounding material 32. It will be noted that the jack is a generally cylindrical member which has a flange extending therefrom forming a lip which is T-shaped in cross section, as shown at 34. This flange serves as a means for fastening, as by way of the screw 36, the jack to the material surrounding the window so that the jack cannot be removed. It will be noted that the head of the screw is countersunk in the flange 34 and when the second portion 38 of the actuator means is in position, a portion of this second portion covers the head of the screw so that it cannot be removed. Both this portion of the jacke and the exposed portion of the second portion 38 of the actuator means are made of an electrically non-conductive material.

In addition to the cylindrical portion with the flange, the jack 28 has electrical contact 40 and 42 which are electrically connected to the circuit 24.

Figure 2:
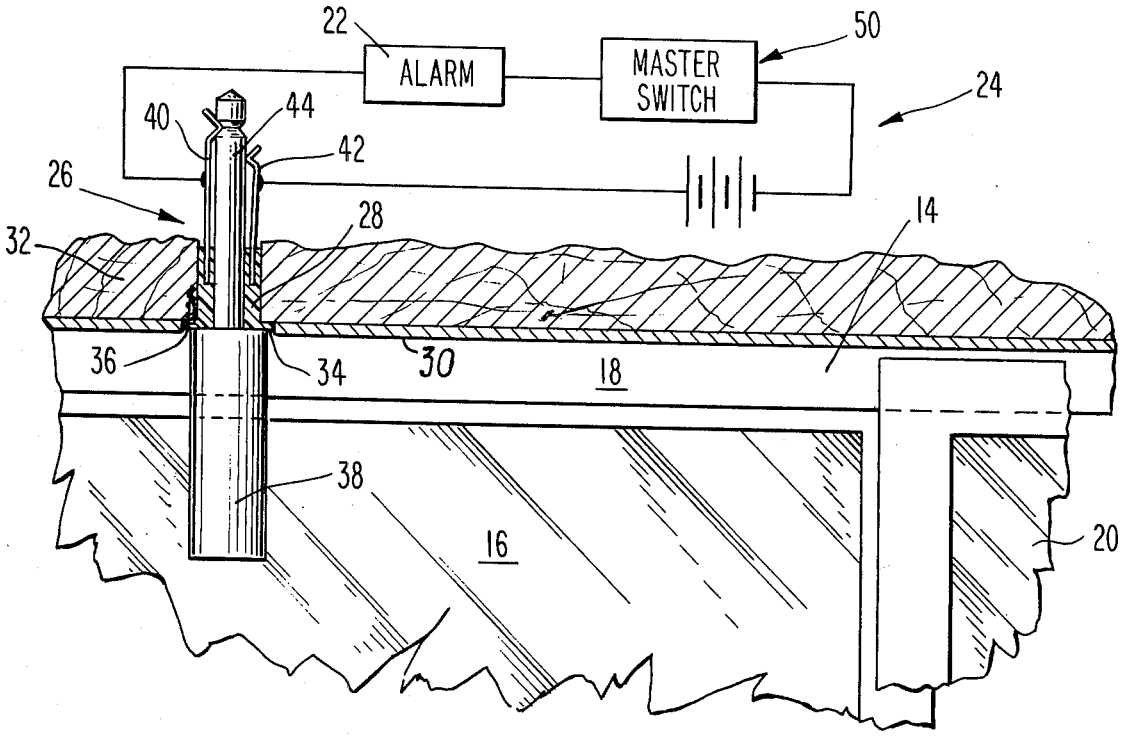
FIG. 2 is a greatly enlarged portion of the apparatus shown in FIG. 1 as defined generally by the rectangle 2 therein, showing my apparatus partially broken away and in position in the frame, partially in section and partially represented schematically.

The second portion 38 comprises an outer sleeve with an inwardly depending shouldered portion having extending therefrom a cylindrical rod 44 made of metal. It will be noted that the rod engages the electrical contacts 40 and 42 in the position shown. This second member 38 is commonly called the plug. It is perhaps ⅜ inch in diameter and 1½ inches long, although it will be understood that the size may vary in accordance with the principles of my invention. Likewise, the extended portion 44 is an inch or an inch and a half in length, and is of a somewhat smaller diameter. The plug is designed to be releasably retained in the jack, as for example, by the spring clip end of the contact 40 resting in the groove in the member 44 as shown in FIG. 2. Of course, alternative means for releasibly retaining the plug in the jack may be provided in accordance with design criteria, all within the scope of my invention.

In the position shown in FIG. 2 it will be noted that the sash 20 may be slid to the left in the position shown in FIGS. 1 and 2 a short distance on the order of, say, 6 inches, thereby allowing for ventilation through the window. However, if it is desired to slide the sash further to the left, the plug 38 must be removed. In removing the plug 38 the member 44 will be removed from engagement with the contacts 40 and 42, thus breaking the circuit 24 and setting off the alarm 22.

Figure 3:
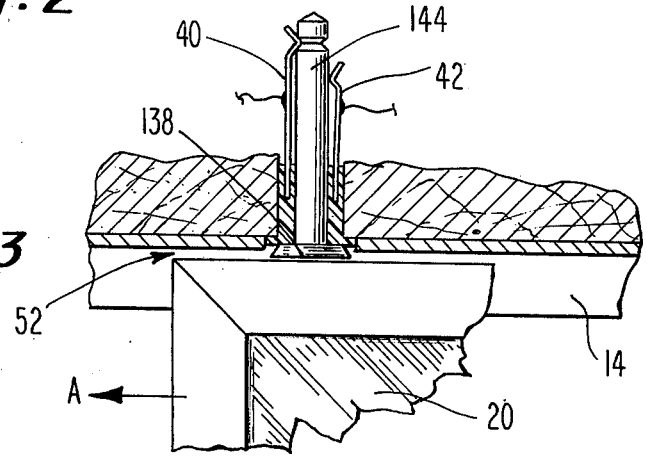
FIG. 3 is a view of a portion of the apparatus shown in FIG. 2, showing an alternate embodiment.

Since the shouldered portion of the member 38 covers the hole through which the portion 44 passes through a portion of the jack 28, there is no way that a potential burglar can jump the alarm activator 26. Thus, any attempt to remove plug 38 to such a position whereby the circuit can be jumped will result in actuation of the alarm. At times, it is desirable to open the window fully, as for example, when changing screens or cleaning. In such a case, it may be desirable not to deactivate the entire alarm system in the remainder of the house. To provide for such contingency, I have provided a master switch, designated generally 50 in FIG. 2, which is engaged with the circuit 24 and which when thrown to a position other than its normal position, will result in de-activation of the alarm. Thus, by throwing the master switch 50 to a position other than its normal position, the jack 38 can be removed without the alarm going off. In FIG. 3, I show a device useful in carrying out the desired ends just referred to. This device consists of the shank portion 144 similar to the portion 44 previously described, but having a flat head 138 in place of the cylindrical member 38. It will be noted that the flat head is designed to fit within the clearance space 52, which would normally be provided between the sash 20 and its surrounding channel support member 14. Once the switch has been thrown and the plug 38 has been removed, the alternate plug 138 is put into position and then the master switch 50 is thrown back to its normal position, which would allow actuation of the alarm. However, since the portion 138 is in position and it contacts the leads 40 and 42, the circuit is complete and the alarm will not go off. Therefore, the sash 20 can be moved in the direction of the arrow A to a fully opened position wherein the window will be fully opened. In this condition, the remaining alarm systems in the house, assuming a plurality of such jacks and plugs, will be fully operable, thereby maximizing safety in the structure.

Figure 4:
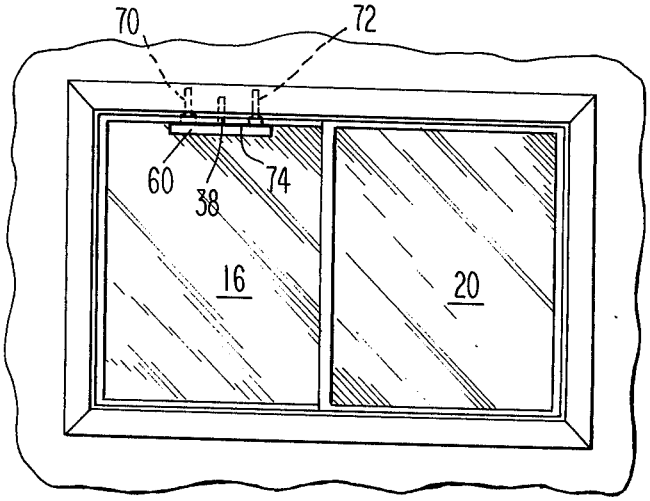
FIG. 4 is a view similar to FIG. 1, again showing an alternate embodiment.
Figure 5:
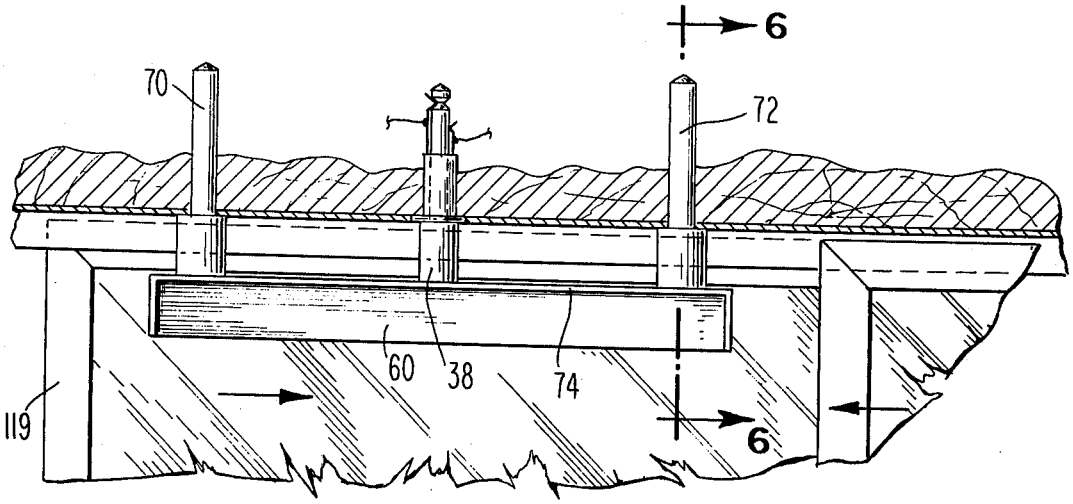
FIG. 5 is a view of a portion of the apparatus shown in FIG. 4 which has been greatly enlarged and shown partially broken away and partially schematically.
Figure 7:
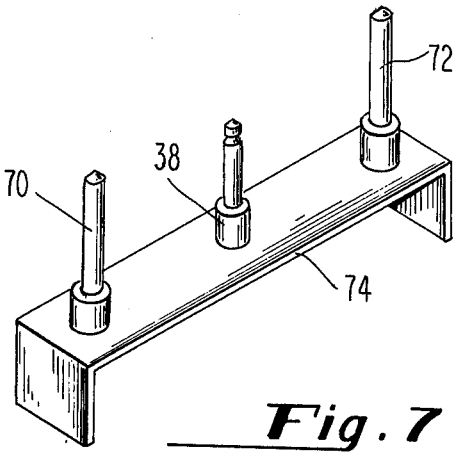
FIG. 7 is a perspective view of a portion of the apparatus shown in FIGS. 5 and 6.
Figure 6:
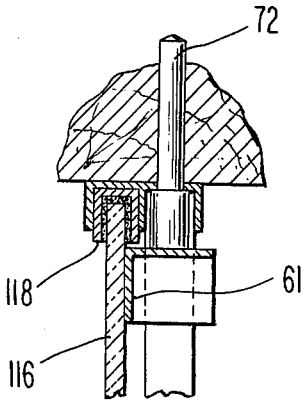
FIG. 6 is a section taken as indicated by the lines and arrows 6—6 in FIG. 5.

It will be noted that what we have described is a plug which is positioned preferably on the inside of a window so that it cannot be tampered with. In the alternate embodiment shown in FIGS. 4–6 I show a plug with an extended flange or channel or bracket member which is useful for preventing movement of either of the two sash members 16 and 20 beyond predetermined limits. In this embodiment the cylindrical portion 38 has fixedly mounted thereto a partially cup-shaped or channel-shaped flange 60. This flange extends in both length and width a distance sufficient to prevent opening of the sash 16 as well as the sash 20, as will be more fully described. Note, for example, in FIG. 6, that the flange is of sufficient depth so that the downwardly extending rear portion 61 of the flange lies against the pane 116 of the sash 16. Since the frame member 118, which is immediately adjacent to the pane 116 and surrounds and retains it, may be narrow in a metal window such as that disclosed, it is desirable to have the channel member 61 be in sliding engagement with the pane in order to interfere with this narrow frame member. It will be understood that the frame member 118 is shown in cross section in FIG. 6, but surrounds the entire glass so that the interference takes place with the vertical portion 119 of the frame 118, as shown in FIG. 5.

The channel member also extends transversely a substantial distance so as to provide for opening of the window sash 20 only a distance of about 6 inches, or the window sash 16 only a distance of about 6 inches. Of course, the dimensions in this regard would vary depending on the size of the window and the desired opening, all within the scope of the present invention. Since this channel member is substantially rectangular and lies flat against the glass, it cannot be rotated about the plug 38 so as to defeat its intended purpose. In addition, I provide two studs 70 and 72 which may be positioned in clearance holes in the surrounding structure and which are fixedly connected to the upper web portion 74 of the channel member. These studs extends from this web portion a distance greater than the length of the plug 38 so that the channel cannot be withdrawn from its fixed position prior to the breaking of the circuit as previously described.

Figure 8:
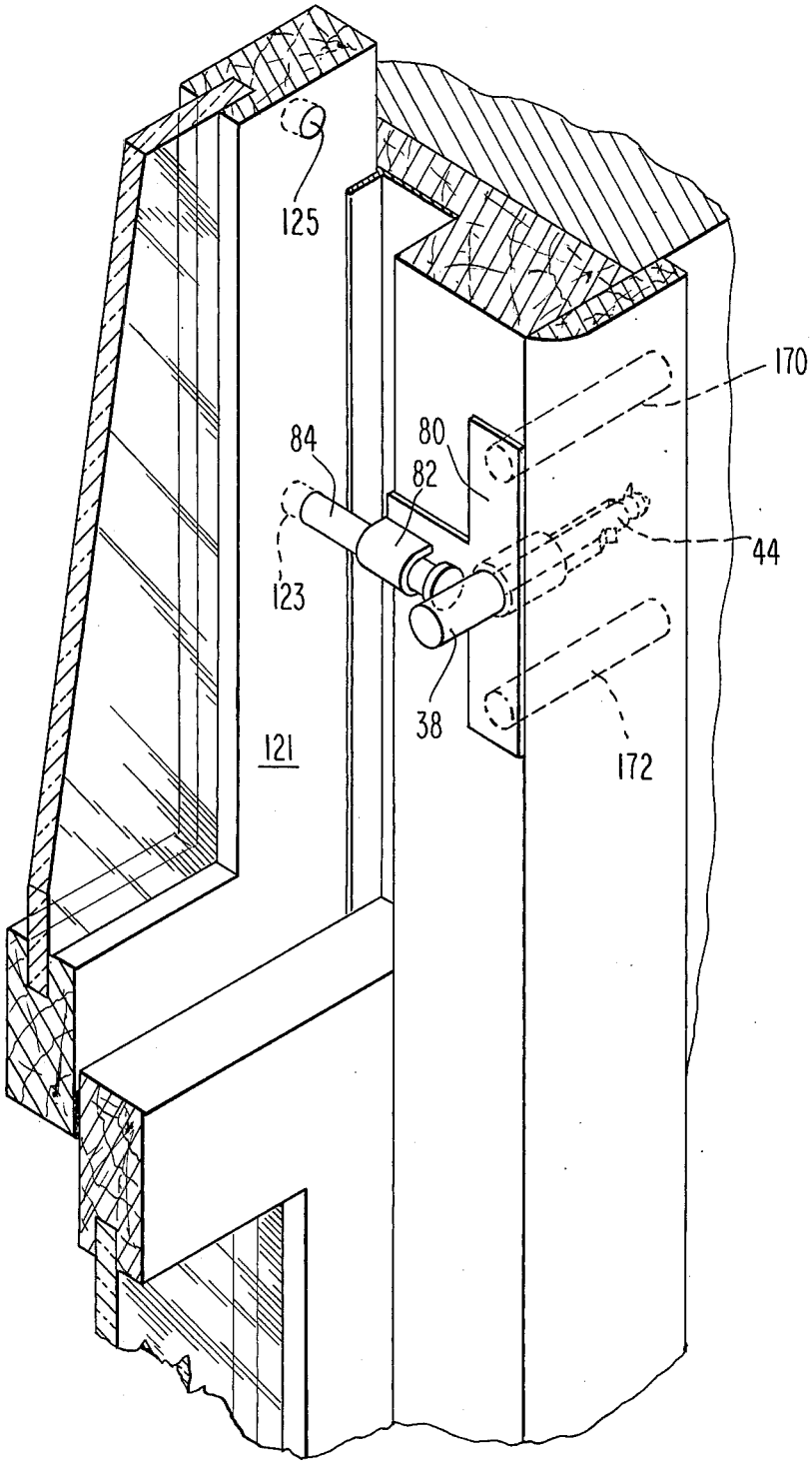
FIG. 8 is a perspective view partially in section showing a further alternate embodiment of my invention.

In a still further embodiment of my invention, as shown in FIG. 8, an apparatus and device is provided for use with vertically hung sash which comprises two sash members, again in a W-shaped channel, mounted in a frame for movement vertically; a so-called "double-hung" sash. In this embodiment, a "T" shaped base plate 80 is positioned between the frame and the shoulder portion of the plug 38. From one face of the "T" shaped base plate two studs 170 and 172, similar to the studs 70 and 72, are fixedly attached and extend, as shown, a greater distance than the length of the portion 44 of the plug 38. On the leg of the "T" I provide a loop of metal 82 which retains a slide bolt 84 for lateral sliding movement. Several holes are drilled into the sash frame 121 as shown at 123, 125, so that the slide bolt 84 can be positioned at several positions as desired. The direction of travel of the slide bolt, as will readily be apparent from the drawing in FIG. 8, is directly interfered with by the positioning of the plug 38. Thus, if it is desired to remove the slide bolt 84 from its engaged position in the hole 123, and slide the sash down, and then replace the slide bolt so that it is in its engaged position in the hole 125, it will be necessary to remove the plug 38. As in the other embodiments, such removal will cause the alarm to be activated unless the master switch 50 is thrown to other than its normal position. In this embodiment, if it is desired to open the window fully and still have the remaining alarm devices actuatable in the house, then the slide bolt 84 is simply removed entirely and the plug 38 replaced and the switch 50 turned to its normal position.

It will also be noted that by use of this embodiment, opening of both the upper sash and the lower sash shown in FIG. 8 can be regulated.

It will be understood that various changes in the details, materials and arrangement of parts which have been herein described and illustrated in order to explain the nature of this invention, may be made by those skilled in the art within the principle and scope of the invention as expressed in the following claims.

For example, the method and means of holding the jack 28 in position in the frame can be varied within the scope of my invention. It will be readily apparent from what has been disclosed in this application that a screw could be positioned transversely to the frame surrounding the window so as to engage the jack 28 and prevent it from being removed from the frame. Likewise, it will be apparent that the head of such a screw should be recessed in the frame and then covered, as by means of putty, in order to prevent its removal.

It will also be apparent from what has been disclosed that the flange 34 on the jack prevents the jack from being forced upwardly into the frame a distance sufficient to permit the window 20, FIG. 2, to slide past the plug 38 carried by the jack 28.

Also in accordance with my invention, the master switch shown in the schematic in FIG. 2 can be an individual shunt switch provided for each window, or a switch for the entire burglar alarm system in the residence or a switch for a portion of that system. In any event, the switch will function to accomplish the same end as previously described with respect to the master switch 50.

With respect to the embodiment shown and described with reference to FIG. 8, the position of the T-shaped base member 80 can be varied as desired, and in particular, it could be positioned so that the slide bolt 84 passes through a hole in both the lower sash and the upper sash simultaneously.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. An alarm device for use in combination with a window sash to prevent the window from being opened more than a predetermined distance without actuating the alarm, while permitting it to be opened at least a predetermined distance without actuating the alarm, comprising:

a. alarm means capable of actuation in response to selected predetermined electrical conditions;

b. circuit means comprising a circuit electrically connected to said alarm means and coacting therewith to provide said electrical conditions upon appropriate actuation;

c. actuation means electrically interconnected with said circuit means and coacting therewith for electrically actuating said alarm means through said circuit, comprising: a first portion normally engaged with said circuit means; and a second portion adapted to be releaseably retained by said first portion and coacting with said first portion in the retained condition to complete the circuit and provide an electrical condition which prevents actuation of the alarm, and coacting with said first portion in a removed condition to break said circuit and thereby provide an electrical condition which actuates said alarm means;

d. said window sash being movable between a first closed position and a second fully opened position, said first and second portions of said actuation means being positioned intermediate said two positions of said window sash; said second portion being positioned in the path of travel of said window sash to prevent said window sash from being moved from the closed to the fully opened position.

2. The invention of claim 1 wherein said first portion is positioned within a frame surrounding said window and said second portion extends therefrom into interfering relation with the sash to permit said sash to be moved from the closed position toward the fully opened position a predetermined distance.

3. The invention of claim 2 wherein said first portion is a jack, and means are provided engaging said jack and fixedly mounting it in said frame; and said second portion is a plug which is so constructed and arranged with respect to said jack that a portion of said plug prevents said last mentioned means from being tampered with when said plug is in the retained condition in said jack.

4. The invention of claim 2 wherein said window sash is mounted in a frame in overlying relation to a second sash movable relative to said first mentioned window sash in the same directions of travel; said second sash comprising a frame surround a pane; and wherein said second portion is provided with a bracket attached thereto extending in the direction of travel of said sashes, which bracket also extends transverse to said direction so as to lie in interfering relation with the frame surrounding the pane of said second sash, thereby preventing the sashs from opening fully as aforesaid.

5. The invention of claim 4 wherein said bracket is provided with a plurality of studs extending therefrom in the same direction and spaced from one another; and said second portion is a plug having an elongated portion extending therefrom for electrical engagement within said first portion with said circuit means; said elongated portion extending in the same direction as said studs and being positioned along said bracket intermediate said studs; said studs extending a greater distance from said bracket than said elongated portion.

6. The invention of claim 1 wherein the second portion engaging the first portion and interfering with the travel of said frame comprises two members, one transversely disposed with respect to the other, and interfering with the travel of the other in at least one direction; the first of these members engaging said circuit means and the second of these members positioned to engage one sash in at least one fixed position to prevent movement of said sash.

7. The invention of claim 6 wherein said first member is a plug and is provided with a T-shaped base plate having studs extending therefrom in a direction substantially parallel to the direction of extension of said plug into engagement with said circuit means and a distance in excess of the distance required for said plug to engage said circuit means and complete said circuit.

8. The invention of claim 2 wherein a switch is provided in said circuit to deactivate said alarm means; and additional means are provided adapted to be substituted for said second portion of said actuation means; said switch means functioning in a first position to permit said substitution without actuating said alarm when said second portion is removed from said first portion; said last mentioned means functioning to complete said circuit in the retained position and together with said switch means in a second position, preventing actuation of said alarm means while in said retained condition, but providing for alarm actuation in a separated condition; said last mentioned means further permitting said window to be fully opened without actuating said alarm means, when in the retained condition.

9. A method of providing a burglar alarm system which allows for partial opening of a window for ventilation while preventing full opening of the window for access therethrough, comprising the steps of:

a. providing an alarm means;

b. providing a circuit means electrically connected to said alarm means; and c. providing an actuation means electrically connected to said circuit means for actuating said alarm means through said circuit means under selected predetermined electrical conditions;

d. positioning said actuation means in the path of travel of said window from a closed condition to a fully opened condition so as to interfere with said travel and in such a way that said actuation means must be actuated in order to continue movement of said window from a closed condition to a fully opened condition; said positioning being at a point whereby said window may be partially opened to allow for ventilation.

10. A burglar alarm set for installation in a window to allow for partially opening of the window for ventilation, while at the same time preventing full opening of the window for access therethrough, comprising:

a. an alarm means;

b. circuit means comprising an electrical circuit for connection to said alarm means;

c. actuation means for electrical connection in said circuit means to said alarm means to actuate said alarm means through said circuit under predetermined electrical conditions, comprising: a first portion for fixed engagement with said circuit means and a frame surrounding said window; and a second portion adapted to be releasably retained by said first portion and to coact therewith in the retained condition to complete said electric circuit and provide an electrical condition which prevents actuation of the alarm means, and adapted to coact with said first portion in the removed condition to break such electric circuit and thereby provide an electrical condition which actuates said alarm means; said second portion adapted to extend from said first portion once said first portion has been fixed with respect to said window frame so as to interfere with the movement of said window frame from a closed condition to a fully opened condition, such that said second portion would have to be removed in order to fully open said window, whereby said alarm would be actuated.

* * * * *